US006568825B2

(12) United States Patent
Chang

(10) Patent No.: US 6,568,825 B2
(45) Date of Patent: May 27, 2003

(54) TOOL HAVING AN ILLUMINATION FUNCTION

(76) Inventor: Chen Tsai Chang, No. 18, His Lin Lane, His Tun Dist., Taichung (TW)

( * ) Notice: Subject to any disclaimer, the term of this patent is extended or adjusted under 35 U.S.C. 154(b) by 0 days.

(21) Appl. No.: 09/953,257

(22) Filed: Sep. 17, 2001

(65) Prior Publication Data

US 2003/0053306 A1 Mar. 20, 2003

(51) Int. Cl.[7] ..... B25B 23/18

(52) U.S. Cl. ..... 362/119; 362/120; 362/109

(58) Field of Search ..... 362/119, 120, 362/109, 206

(56) References Cited

U.S. PATENT DOCUMENTS 6,116,746 A * 9/2000 Hsu ..... 362/102

* cited by examiner

*Primary Examiner*—Sandra O'Shea
*Assistant Examiner*—Bertrand Zeade
(74) *Attorney, Agent, or Firm*—Rosenberg, Klein & Lee

(57) ABSTRACT

A tool having an illumination function includes a tool body, and a light emitting device. The tool body includes a drive head having a first face provided with a mounting hole, and a second face provided with a protruding operation head located adjacent to the mounting hole. The light emitting device is mounted in the mounting hole and includes a light emitting member. The light emitting member is disposed in an inclined manner, and is directed toward the operation head of the drive head of the tool body. In addition, the light emitting member is not protruded outward from the second face of the drive head of the tool body.

6 Claims, 4 Drawing Sheets

TOOL HAVING AN ILLUMINATION FUNCTION

BACKGROUND OF THE INVENTION

1. Field of the Invention

The present invention relates to a tool having an illumination function, and more particularly to a tool having an illumination function, wherein the light emitted outward from the light emitting member may be projected onto the workpiece in an oblique manner, thereby providing an efficient illuminating function to the workpiece, such that the user may clearly see the instant position of the workpiece, thereby facilitating the user operating and rotating the workpiece.

2. Description of the Related Art

A conventional tool such as a ratchet wrench, a socket wrench, an open-ended spanner or the like, may operate and rotate a workpiece such as a nut, bolt or the like, thereby capable of screwing or unscrewing the workpiece. However, when the tool is used to operate the workpiece in a dark region or corner, the tool cannot exactly touch the workpiece due to the bad viewing condition, thereby greatly influencing the user driving the tool to operate the workpiece.

In addition, when the tool is used at the night, the user's one hand has to hold the tool, and the other hand has to hold a flashlight to provide an illuminating function, thereby greatly causing inconvenience to the user. If the tool is used to operate the workpiece at a higher position, the user cannot support his body by his hand because both of his two hands are busy, thereby easily causing danger to the user when he loses balance.

Another conventional tool includes a drive head provided with an operation portion which is provided with a light emitting member. However, when the operation portion is combined with a socket wrench to operate a workpiece, the light emitted from the light emitting member will be interrupted, thereby losing the illuminating effect.

The light emitting member may be mounted on the handle of the tool. However, the light emitting member is spaced from the operation portion of the tool to far, so that the illuminating effect is too poor. In addition, the light emitting member is protruded outward the surface of the handle, so that the light emitting member is easily worn out due to hit or collision.

SUMMARY OF THE INVENTION

The present invention has arisen to mitigate and/or obviate the disadvantage of the conventional tool.

The primary objective of the present invention is to provide a tool having an illumination function, wherein the light emitted outward from the light emitting member may be projected onto the workpiece in an oblique manner, thereby providing an efficient illuminating function to the workpiece, such that the user may clearly see the instant position of the workpiece, thereby facilitating the user operating and rotating the workpiece.

Another objective of the present invention is to provide a tool having an illumination function, wherein the light emitting member is not protruded outward from the second face of the drive head of the tool body, and is spaced from the operation head of the drive head of the tool body with a determined distance, such that the light emitting member is not easily worn or broken due to hit or collision.

A further objective of the present invention is to provide a tool having an illumination function, wherein the rotary cover may be rotated easily by driving the opposite bosses, such that the battery may be mounted and replaced easily and conveniently.

In accordance with the present invention, there is provided a tool having an illumination function, comprising:

a tool body having a first end formed with a drive head, and a second end formed with a handle, the drive head of the tool body having a first side formed with a first face, and a second side formed with a second face, the first face of the drive head of the tool body provided with a mounting hole, the second face of the drive head of the tool body provided with a protruding operation head located adjacent to the mounting hole; and a light emitting device mounted in the mounting hole of the drive head of the tool body, and including a light emitting member; wherein:

the light emitting member is disposed in an inclined manner, and is directed toward the operation head of the drive head of the tool body;

the light emitting member is not protruded outward from the second face of the drive head of the tool body.

Preferably, the light emitting device includes a lamp base mounted in the mounting hole of the drive head of the tool body for receiving the light emitting member.

Preferably, the light emitting device includes at least one battery mounted in the lamp base.

Preferably, the light emitting device includes a rotary cover secured on the lamp base.

Preferably, the rotary cover is provided with a switch.

Preferably, the rotary cover is provided with two opposite bosses.

Further benefits and advantages of the present invention will become apparent after a careful reading of the detailed description with appropriate reference to the accompanying drawings.

DETAILED DESCRIPTION OF THE INVENTION

Figure 1:
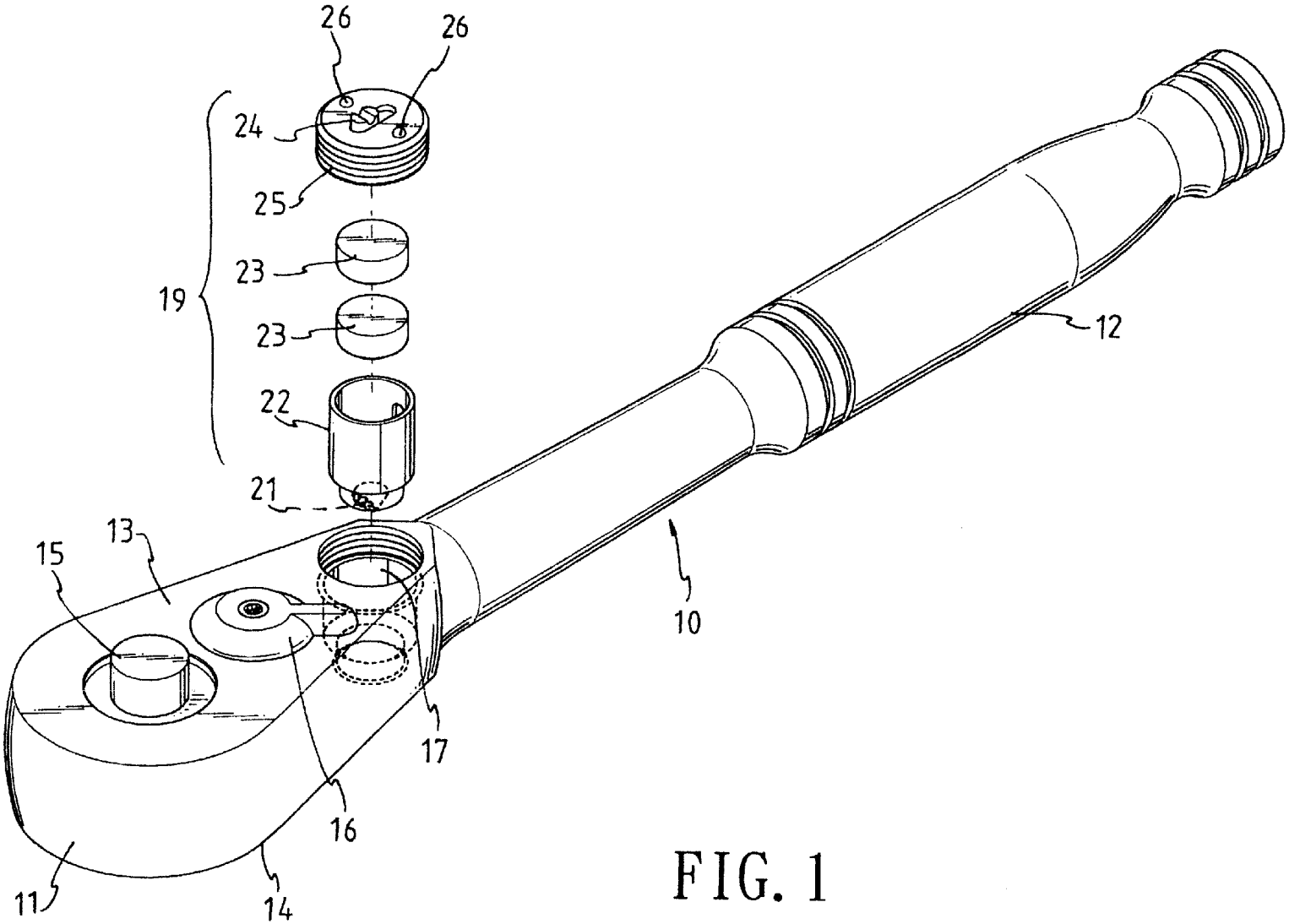
FIG. 1 is an exploded perspective view of a tool having an illumination function in accordance with the preferred embodiment of the present invention.
Figure 2:
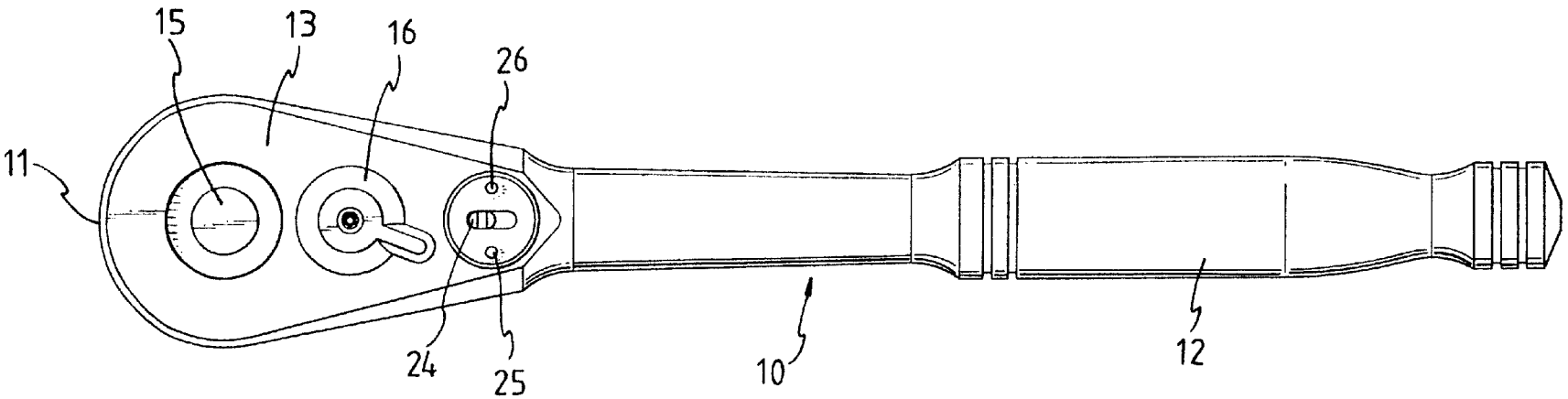
FIG. 2 is a plan assembly view of the tool having an illumination function as shown in FIG. 1.
Figure 3:
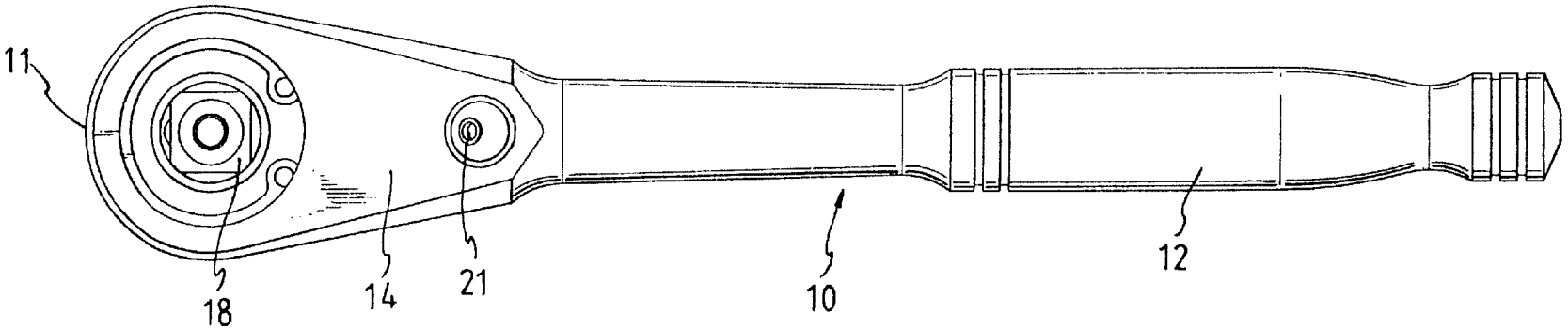
FIG. 3 is a plan assembly view of the tool having an illumination function as shown in FIG. 1.

Referring to the drawings and initially to FIGS. 1–3, a tool having an illumination function in accordance with the preferred embodiment of the present invention is preferably adapted to function as a ratchet wrench. The tool comprises a tool body 10 having a first end formed with a drive head 11, and a second end formed with a handle 12.

The drive head 11 of the tool body 10 has a first side formed with a first face 13, and a second side formed with a second face 14. The first face 13 of the drive head 11 of the tool body 10 is provided with a push button 15 and a switch button 16 located adjacent to the push button 15. The first face 13 of the drive head 11 of the tool body 10 is provided with a penetrated mounting hole 17 located adjacent to the switch button 16. The second face 14 of the drive head 11 of the tool body 10 is provided with a protruding operation head 18 (see FIG. 4). The operation head 18 of the drive head 11 of the tool body 10 may be controlled by the push button 15 to be fitted with or detached from a socket (not shown). The operation head 18 may also be controlled by the switch button 16 so as to change the operation direction.

A light emitting device 19 is mounted in the mounting hole 17 of the drive head 11 of the tool body 10. The light emitting device 19 includes a lamp base 22, a light emitting member 21 mounted in a first end of the lamp base 22, two batteries 23 mounted in the lamp base 22, and a rotary cover 25 secured in a second end of the lamp base 22. The rotary cover 25 is provided with a switch 24, and is protruded with two bosses 26. The user may drive the bosses 26 to rotate the rotary cover 25.

Figure 4:
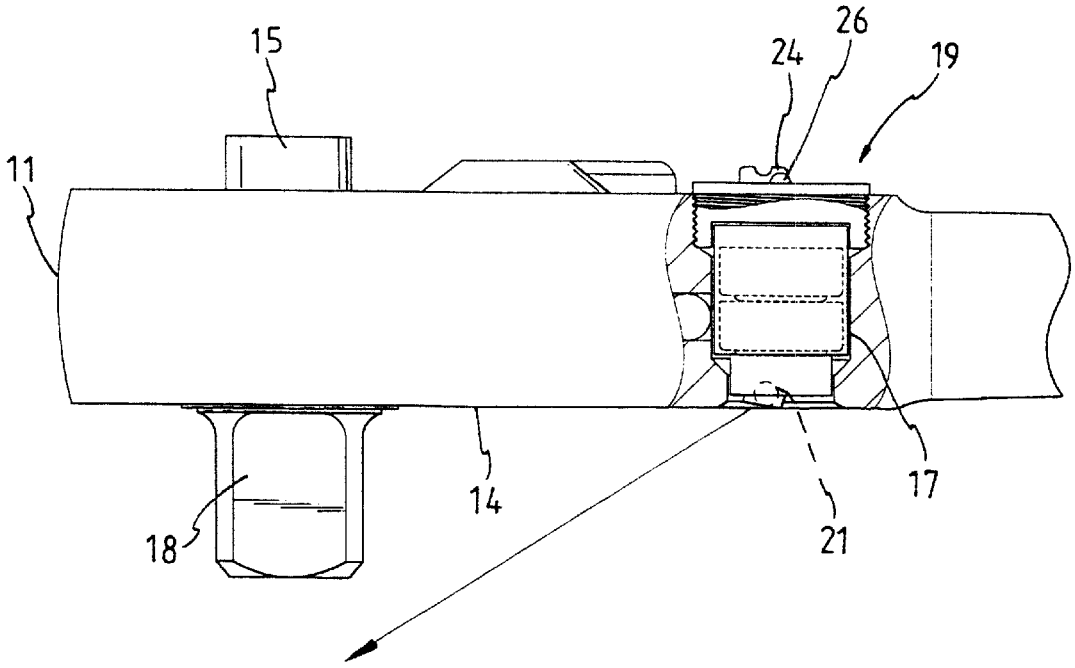
FIG. 4 is a cross-sectional assembly view of the tool having an illumination function as shown in FIG. 1.

Referring to FIG. 4, it is appreciated that, after the light emitting device 19 is mounted in the mounting hole 17 of the drive head 11 of the tool body 10, the light emitting member 21 is disposed in an inclined manner, and is directed toward the operation head 18 of the drive head 11 of the tool body 10. In addition, the light emitting member 21 is hidden in the lamp base 22, and is not protruded outward from the second face 14 of the drive head 11 of the tool body 10.

In use, the operation head 18 of the drive head 11 of the tool body 10 is fitted into a socket (not shown) to operate and rotate a workpiece (not shown) such as a nut, a bolt or the like. The light emitting member 21 may emit light outward from the lamp base 22 by switching the switch 24. At this time, although the light emitting member 21 is spaced from the operation head 18 of the drive head 11 of the tool body 10 with a determined distance, the light emitted from the light emitting member 21 may be obliquely projected onto the workpiece as indicated by the arrow shown in FIG. 4, thereby capable of providing an efficient illuminating function to the workpiece, such that the user may clearly see the instant position of the workpiece, thereby facilitating the user operating and rotating the workpiece.

It is appreciated that, the light emitting member 21 does not protrude outward from the second face 14 of the drive head 11 of the tool body 10, and the light emitting member 21 is spaced from the operation head 18 of the drive head 11 of the tool body 10 with a determined distance, such that the light emitting member 21 is not easily worn or broken due to hit or collision.

Again referring to FIG. 1, the rotary cover 25 is provided with two opposite bosses 26, so that the user may exert a force on the bosses 26 to rotate the rotary cover 25, thereby screwing or unscrewing the rotary cover 25, so that the battery 23 may be mounted and replaced easily and conveniently.

Accordingly, the tool having an illumination function in accordance with the present invention has the following advantages.

1. The light emitted outward from the light emitting member 21 may be projected onto the workpiece in an oblique manner, thereby providing an efficient illuminating function to the workpiece, such that the user may clearly see the instant position of the workpiece, thereby facilitating the user operating and rotating the workpiece.

2. The light emitting member 21 is not protruded outward from the second face 14 of the drive head 11 of the tool body 10, and is spaced from the operation head 18 of the drive head 11 of the tool body 10 with a determined distance, such that the light emitting member 21 is not easily worn or broken due to hit or collision.

3. The rotary cover 25 may be rotated easily by driving the opposite bosses 26, such that the battery 23 may be mounted and replaced easily and conveniently.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool having an illumination function, comprising:

a tool body having a first end formed with a drive head, and a second end formed with a handle, said drive head of said tool body having a first side formed with a first face and a second side formed with a second face, said drive head of said tool body having formed therein a mounting hole extending transversely between said first and second faces, said drive head of said tool body having an operation head protruding from said second face, said operation head being offset from said mounting hole; and a light emitting device mounted in said mounting hole of said drive head of said tool body, said light emitting device including a light emitting member disposed in an inclined manner within said mounting hole, said light emitting member being obliquely directed toward said operation head of said drive head of said tool body, said light emitting member being operable thereby to project light directly and obliquely toward said operation head;

said light emitting device remaining recessed in position relative to said second face of said drive head of said tool body.

2. The tool having an illumination function in accordance with claim 1, wherein said light emitting device includes a lamp base mounted in said mounting hole of said drive head of said tool body for receiving said light emitting member.

3. The tool having an illumination function in accordance with claim 1, wherein said light emitting device includes at least one battery mounted in said lamp base.

4. The tool having an illumination function in accordance with claim 2, wherein said light emitting device includes a rotary cover detachably mounted on said lamp base.

5. The tool having an illumination function in accordance with claim 4, wherein said rotary cover is provided with a switch.

6. The tool having an illumination function in accordance with claim 4, wherein said rotary cover is provided with two opposite bosses.

* * * * *